US009638490B1

(12) United States Patent
Shen

(10) Patent No.: US 9,638,490 B1
(45) Date of Patent: May 2, 2017

(54) PNEUMATIC FIRING DEVICE

(71) Applicant: Liang-Chi Shen, Taoyuan (TW)

(72) Inventor: Liang-Chi Shen, Taoyuan (TW)

( * ) Notice: Subject to any disclaimer, the term of this patent is extended or adjusted under 35 U.S.C. 154(b) by 0 days.

(21) Appl. No.: 14/980,528

(22) Filed: Dec. 28, 2015

(51) Int. Cl.

| | |
|---|---|
| ***F41B 11/71*** | (2013.01) |
| ***F41B 11/89*** | (2013.01) |
| ***F41B 11/723*** | (2013.01) |
| ***F41B 11/50*** | (2013.01) |
| ***F41B 11/643*** | (2013.01) |

(52) U.S. Cl.
CPC ..... *F41B 11/71* (2013.01); *F41B 11/50* (2013.01); *F41B 11/643* (2013.01); *F41B 11/723* (2013.01); *F41B 11/89* (2013.01)

(58) Field of Classification Search
CPC ..... F41B 11/72; F41B 11/721; F41B 11/722; F41B 11/723; F41B 11/73; F41B 11/89; F41B 11/71; F41B 11/50; F41B 11/643
USPC ..... 124/71, 73, 74, 77
See application file for complete search history.

(56) References Cited

U.S. PATENT DOCUMENTS 5,505,188 A * 4/1996 Williams ..... F41B 11/52 124/49
5,613,483 A * 3/1997 Lukas ..... F41B 11/724 124/70
7,299,796 B2 * 11/2007 Kirwan ..... F41B 11/721 124/71
2003/0168052 A1 * 9/2003 Masse ..... F41B 11/57 124/73
2007/0028909 A1 * 2/2007 Wood ..... F41B 11/723 124/73
2007/0151548 A1 * 7/2007 Long ..... F41B 11/721 124/73
2009/0255523 A1 * 10/2009 Lian ..... F41B 11/721 124/73
2009/0301459 A1 * 12/2009 Lian ..... F41B 11/721 124/76
2011/0088675 A1 * 4/2011 Wood ..... F41B 11/721 124/73
2012/0031386 A1 * 2/2012 Masse ..... F41B 11/57 124/73
2012/0090586 A1 * 4/2012 Wood ..... F41B 11/721 124/73
2015/0253101 A1 * 9/2015 Scarr ..... F41B 11/73 124/73

* cited by examiner

*Primary Examiner* — Bret Hayes
(74) *Attorney, Agent, or Firm* — Rosenberg, Klein & Lee

(57) ABSTRACT

A pneumatic firing device includes a rear section engaging a cylinder, a solenoid valve engaging the rear section from under, an adjusting element disposed inside the rear section, a piston disposed inside the cylinder to form a first chamber and a second chamber, an airflow guiding element engaging the cylinder at the front thereof, a moving rod having a tail end engaging the piston and a front end stretching through the cylinder into the airflow guiding element for controlling the operation of the airflow guiding element, and a front section engaging the front of the airflow guiding element. The solenoid valve holds control of the operation of a pressure release channel to change the pressure difference between the first and second chamber, making the pressured air entering a first passage from a first guiding hole of the airflow guiding element, pushing the delivery tube to a firing position, flowing into a second passage from a second guiding hole, and then firing a pellet with strong airflow.

9 Claims, 11 Drawing Sheets

PNEUMATIC FIRING DEVICE

BACKGROUND OF THE INVENTION

1. Field of the Invention

The present invention relates to a pneumatic firing device, particularly to one that fires pellets by airflows produced from the operation of a pressure release channel and that is especially suitable for application to Ball Bearing guns, also known as BB guns.

2. Description of the Related Art

Nowadays people like to play war games like paintball and survival games with air gun including BB guns that are highly intense for stress relief, especially those living in cities.

Both BB guns and paintball guns fire the pellets by pressured air, mechanically or electronically. A mechanical firing has a trigger controlling the air passage within the device to fire, each pulled for one shot, but a user of mechanical guns cannot pull the trigger fast enough for rapid fires. An electronic firing has a trigger controlling the operation of a solenoid valve in the device to fire, and it is able to conduct rapid fire.

Such design of air guns has pressured air as the driving force for firing with adjustments by the structure. In U.S. Pat. No. 5,727,538, U.S. Pat. No. 6,516,791, and U.S. Pat. No. 6,532,949, different projectile firing devices and pneumatic operations are disclosed; however, when combining the electronic devices with the pneumatically driven operations, the mechanic devices would encounter more complexities for operations which then become potential problems. Also, the costs for manufacturing would increase as well.

U.S. Pat. No. 6,601,780 and U.S. Pat. No. 6,925,997 disclosed a pneumatic operation for firing a paintball gun, which ensure more safety and less malfunctions with a faster firing speed. But displacement of a flow-guiding piston thereof within a flow-guiding body cannot be adjusted during operation; therefore the device is unable to adjust changes of the airflow within the device in operation.

Therefore, it is desirable to overcome the problems and defects disclosed and further find improvements for such devices.

SUMMARY OF THE INVENTION

A primary object of the present invention is to provide a pneumatic firing device that has a smooth operation of firing with less malfunctions and faster firing speed.

Another object of the present invention is to provide a pneumatic firing device that has simple structure for easy assembly and low prime cost.

Yet another object of the present invention is to provide a pneumatic firing device that is able to adjust the firing speed.

In order to achieve the objects above, the present invention comprises a hollow cylinder including a first opening arranged at an end thereof, a second opening arranged at the other end thereof, and a first entry hole arranged at the bottom thereof for connecting an external air supply tube; a rear section having a front end thereof engaging the second opening of the cylinder, a first hole arranged at a front part thereof, a screw hole arranged at a rear part thereof connecting to the first hole, and a pressure release vent arranged at the bottom thereof connecting to the first hole; the pressure release vent further linking to a pressure release room at the bottom; a solenoid valve connecting to the pressure release room from under and having a movable plunger as a gate for opening and closing the pressure release room; the movable plunger having a first outlet arranged on the periphery of a hollow lower part thereof, and a second outlet arranged at the bottom of the solenoid valve for the air released from the pressure release room to be discharged therefrom via the first outlet and the second outlet; an adjusting element engaging in the first hole of the rear section with a tail section arranged as a threaded section for screwing the screw hole and a front part including a pressure release channel; said pressure release channel having a through hole at the front thereof and connecting the pressure release vent at the rear thereof; a piston disposed in the second opening with an engaging hole arranged at the front thereof and a connecting hollow arranged at the rear thereof for connecting to the engaging hole; the piston further forming a first gap between which and the adjusting element when moving forward; an airflow guiding element engaging the cylinder from the front and having a tube body with a first diameter at the front section thereof, a ring element with a second diameter at the rear thereof, and a guiding passage connecting the tube body and the ring element; the second diameter being loner than the first diameter; the tube body further having at least one first guiding hole arranged thereon at the side near the ring element, forming a first passage connecting the cylinder, and at least one second guiding hole arranged thereon at the side far from the ring element; at least one O-ring being arranged on the tube body between the first guiding hole and the second guiding hole, and an axial hole being arranged within the tube body between the first guiding hole and the second guiding hole, forming a second passage connecting the second guiding hole; a moving rod having a tail end engaging the engaging hole of the piston, a second entry hole to link up with the connecting hollow, and a front end stretching out the cylinder into the airflow guiding element and including a valve with a diameter of a length between the first and second diameter; said valve further including a stick as the front of the stick stretching through the axial hole, forming a blocking section to control the blocking of the axial hole upon being driven by the moving rod in operation; when the moving rod moving backward and the valve leaving the guiding passage, a second gap being formed in between, and when the moving rod moving forward, a third gap being formed between the blocking section and the axial hole; a front section engaging the airflow guiding element and having a second hole; a delivery tube including a first tube and a second tube connecting with each other; the diameter of the first tube being longer than the one of the second tube for engaging the tube body, and a first O-ring being arranged on the surface of the first tube corresponding to the second hole for the delivery tube to displace in the second hole; the first tube further connecting the second passage to form a passage for firing, and when the delivery tube returning to the original position, a fourth gap being formed between the first tube and the first guiding hole; a first spring mounted around the second tube and positioned at the front of the front section by a positioning element in order to constantly provide an inward force for the delivery tube, so as to confine its displacement; whereby the solenoid valve holds control of the operation of the pressure release channel to change the pressure difference between a first chamber arranged at a front side of the piston and a second chamber arranged at a rear side of the piston, then the pressured air would flow into the first passage via the first guiding hole of the airflow guiding element, displacing the delivery tube and driving a pellet therein to move forward, and then flow into the second passage via the second guiding hole to fire the pellet from the passage for firing with strong airflow.

In addition, in a preferred embodiment, the present invention further includes a small second spring disposed between the adjusting element and the connecting hollow for providing an ejection force for the piston to move forward; and the adjusting element further has a non-circular socket arranged at a tail end thereof for a wrench to adjust the position of the adjusting element from the screw hole of the rear section.

A plurality of blades is arranged at the middle section of the stick and the blocking section has inclined surfaces extending to both ends. The positioning element is a short bolt to be fixed in a front screw hole at the front of the front section, and the positioning element further has a protruding abutting surface arranged on the inner periphery for positioning the first spring.

The front section further has a first concave end engaging a first convex end of the airflow guiding element, and the first convex end has a second O-ring mounted thereon in order to seal the engaging ends. The rear section further has a second concave end with a third O-ring mounted thereon to seal the engaging rear section and second tube of the cylinder.

The delivery tube is further engaging a loading device including a loading entry for the supply of pellets and a barrel being arranged perpendicularly to the loading entry and connecting the delivery tube; and the device and the loading device are disposed inside a housing, and the housing further includes a grip arranged corresponding to the solenoid valve and the external air supply tube; the grip further has an air inlet connecting the external air supply tube.

With features disclosed above, the present invention changes the pressure difference between the first chamber and the second chamber, controls the operation of the pressure release channel to push forward the delivery tube with pressured air, sending a pellet therein into the passage for firing, and then fires the pellet from the second passage with strong airflow. Such structure enables a smooth airflow for operation, less malfunctions, and faster firing speed. The adjusting element can also adjust the firing speed by displacement to control the operation of the piston.

DETAILED DESCRIPTION OF THE PREFERRED EMBODIMENT

Figure 7:
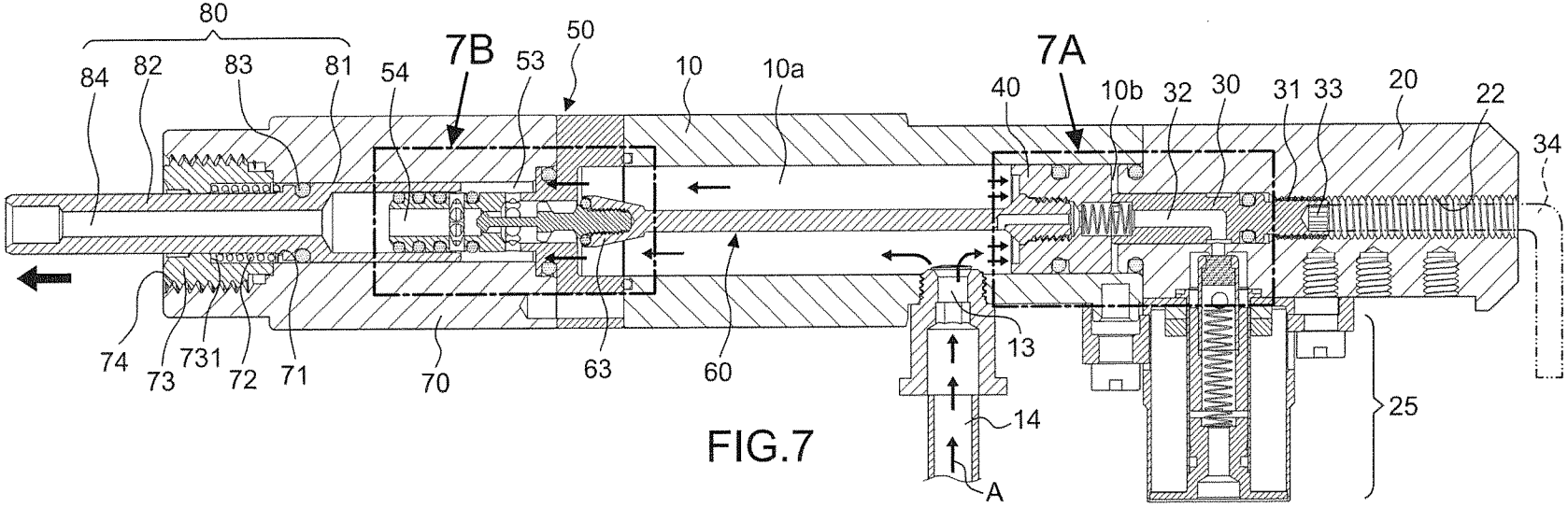
FIG. 7 is a sectional view of the present invention illustrating the movable plunger in a closing status.
Figure 7A:
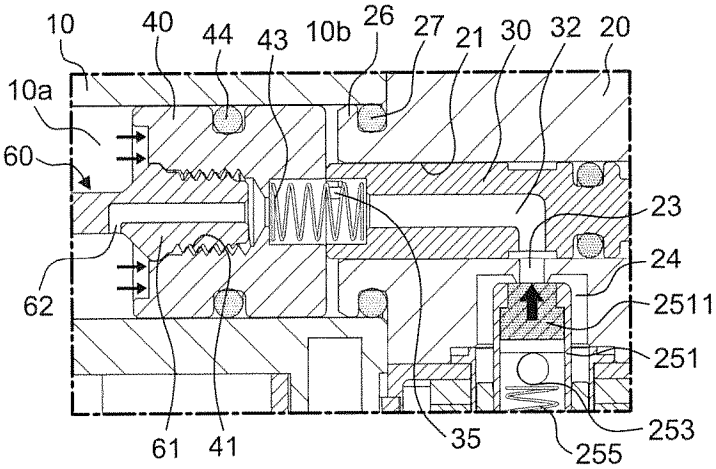
FIG. 7A is an enlarged view of area 7A in FIG. 7.
Figure 8:
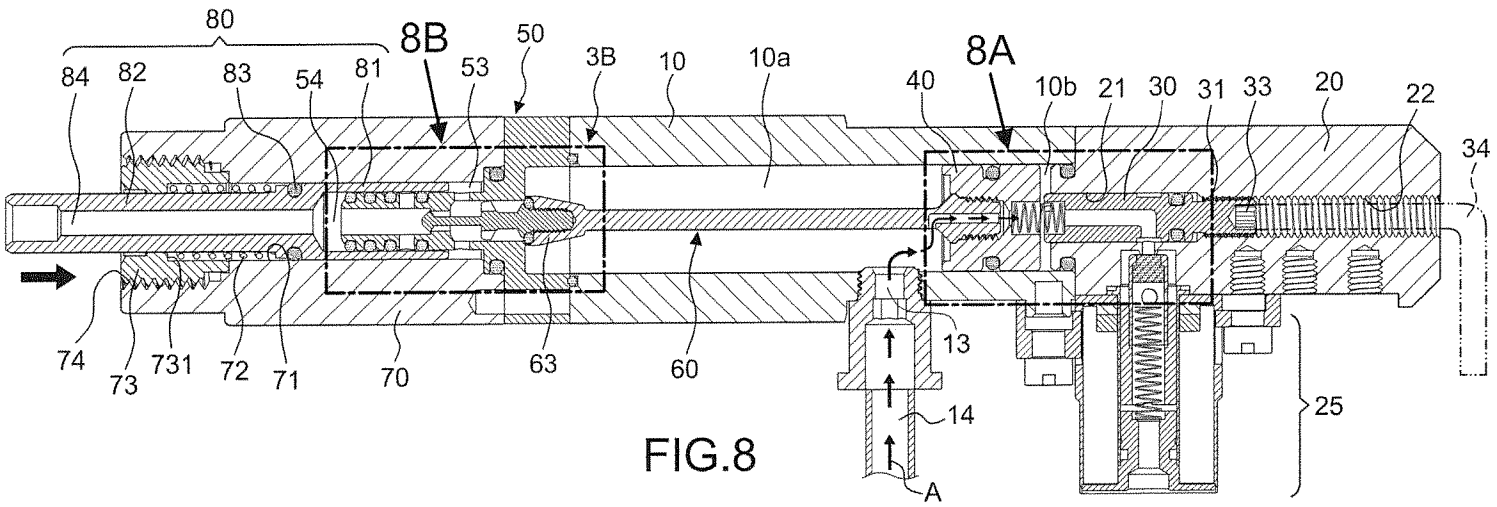
FIG. 8 is a sectional view of the present invention illustrating the movable plunger closing, a delivery tube thereof returning back, and airflow in the second hole being discharged from a blocking section thereof via the first guiding hole.
Figure 8A:
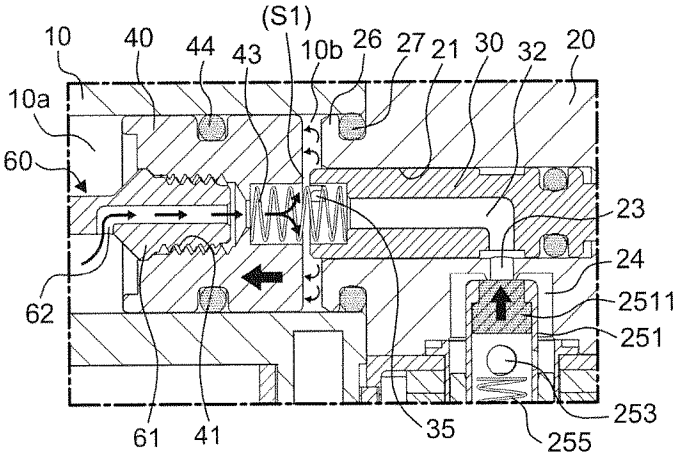
FIG. 8A is an enlarged view of area 8A in FIG. 8.
Figure 9:
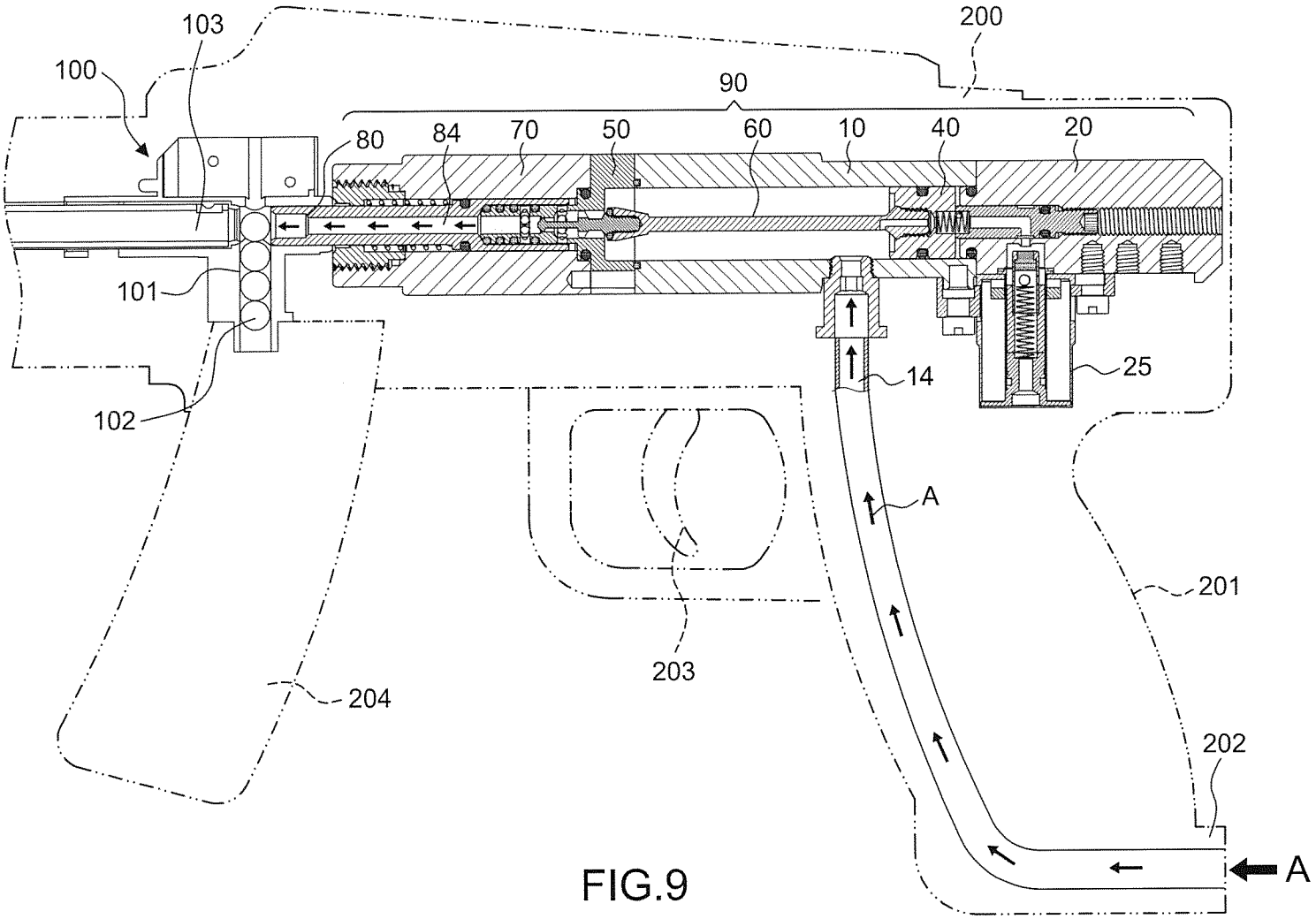
FIG. 9 is a practical application view of the present invention applied to a Ball Bearing gun.

A preferred embodiment is illustrated in FIGS. 1-9, among which FIG. 9 is a practical application view of the present invention applied to a Ball Bearing gun (BB gun). Referring to FIGS. 1-3C, the present invention, a pneumatic firing device 90, includes a hollow cylinder 10, a rear section 20, a solenoid valve 25, an adjusting element 30, a piston 40, an airflow guiding element 50, a moving rod 60, a front section 70, a delivery tube 80, and a first spring 72.

The hollow cylinder 10 includes a first opening 11 arranged at an end thereof, a second opening 12 arranged at the other end thereof, and a first entry hole 13 arranged at the bottom thereof for connecting an external air supply tube 14.

The rear section 20 has a front end thereof engaging the second opening 12, a first hole 21 arranged at a front part thereof, a screw hole 22 arranged at a rear part thereof connecting to the first hole 21, and a pressure release vent 23 arranged at the bottom thereof connecting to the first hole 21. The pressure release vent 23 further links to a pressure release room 24 at the bottom. In this embodiment, the rear section 20 further has a second concave end 26 with a third O-ring 27 mounted thereon to seal the engaging rear section 20 and second tube 12 of the cylinder 10.

The solenoid valve 25 connects to the pressure release room 24 from under by at least one screw 256 and has a movable plunger 251 as a gate for opening and closing the pressure release room 24. The movable plunger 251 has a first outlet 253 arranged on the periphery of a hollow lower part with a third spring 255 disposed therein, and a second outlet 254 arranged at the bottom of the solenoid valve 25 for the air released from the pressure release room 24 to be discharged therefrom via the first outlet 253 and the second outlet 254. In this embodiment, the movable plunger 251 is a movable iron core at the center of the solenoid valve 25, having a rubber piece 2511 at the front end thereof, so that when a surrounding coil 252 is activated by electric currents, the movable plunger 251 is able to stretch out and return to control the operation of the pressure release vent 23.

The adjusting element 30 engages in the first hole 21 of the rear section 20 with a tail section arranged as a threaded section 31 for screwing the screw hole 22 and a front part including a pressure release channel 32. The pressure release channel 32 further has a through hole 35 at the front thereof and connects the pressure release vent 23 at the rear thereof. In this embodiment, the adjusting element 30 has a non-circular socket 33 arranged at a tail end thereof for a wrench 34 to adjust the displacement of the adjusting element 30 in the first hole 21 from the screw hole 22 of the rear section. For example, the non-circular socket 33 is a hexagonal socket, and the wrench 34 is an L wrench.

The piston 40 is disposed in the second opening 12 with an engaging hole 41 arranged at the front thereof and a connecting hollow 42 arranged at the rear thereof for connecting to the engaging hole 41. The piston 40 further has a fourth O-ring 44 arranged on the periphery thereof. In a preferred embodiment, the present invention includes a small second spring 43 disposed between the adjusting element 30 and the connecting hollow 42 for providing an ejection force for the piston 40 to move forward; the piston 40 can also be driven by airflows in other embodiments.

The airflow guiding element 50 engages the cylinder 10 from the front and has a tube body 51 with a first diameter 511 at the front section thereof, a ring element 52 with a second diameter 521 at the rear thereof, and a guiding passage 522 connecting the tube body 51 and the ring element 52. The second diameter 521 is longer than the first diameter 511, and the tube body 51 further has at least one first guiding hole 512 arranged thereon at the side near the ring element 52, forming a first passage 53 connecting the cylinder 10, and at least one second guiding hole 513 arranged thereon at the side far from the ring element 52; at least two O-rings 514 are further arranged on the tube body 51, at least one of which is arranged between the first guiding hole 512 and the second guiding hole 513. Additionally, an axial hole 515 is arranged within the tube body 51 between the first guiding hole 512 and the second guiding hole 513, forming a second passage 54 connecting the second guiding hole 513; the second passage 54 is also the major passage for firing.

The moving rod 60 has a tail end 61 engaging the engaging hole 41 of the piston 40, a second entry hole 62 to link up with the connecting hollow 42, and a front end stretching out the cylinder 10 into the airflow guiding element 50 and including a valve 63 with a diameter of a length between the first and second diameter 511, 521. The valve 63 further includes a stick 64 as the front of which stretching through the axial hole 515, forming a blocking section 65 to control the blocking of the axial hole 515 upon being driven by the moving rod 60 in operation. The blocking section 65 has inclined surfaces extending to both ends so that when the moving rod 60 is moving backward and the valve 63 is leaving the guiding passage 522, a second gap S2 is formed in between, and when the moving rod 60 is moving forward, a third gap S3 is formed between the blocking section 65 and the axial hole 515.

In this embodiment, a plurality of blades 641 is arranged at the middle section of the stick 64 for a stably axial displacement within the airflow guiding element 50. The front section 70 engages the front of the airflow guiding element 50 and has a second hole 71. Furthermore, it has a first concave end 75 engaging a first convex end 55 of the airflow guiding element 50, and the first convex end 55 has a second O-ring 56 mounted thereon in order to seal the engaging ends.

The delivery tube 80 includes a first tube 81 and a second tube 82 connecting with each other. The diameter of the first tube 81 is longer than the one of the second tube 82 for engaging the tube body 51, and a first O-ring 83 is arranged on the surface of the first tube 81 corresponding to the second hole 71 for the delivery tube 80 to displace in the second hole 71. The first tube 81 further connects the second passage 54 to form a passage for firing 84, and when the delivery tube 80 returns to the original position, a fourth gap S4 is formed between the first tube 81 and the first guiding hole 512.

The first spring 72 is mounted around the second tube 82 and positioned at the front of the front section 70 by a positioning element 73 in order to constantly provide an inward force for the delivery tube 80, so as to confine its displacement. In this embodiment, the positioning element 73 is a short bolt to be fixed in a front screw hole 74 at the front of the front section 70, and it has a protruding abutting surface 731 arranged on the inner periphery for positioning the first spring 72.

Further referring to FIG. 9, the present invention is applied to a BB gun. In the application, the delivery tube 80 is engaging a loading device 100 including a loading entry 101 for the supply of airsoft pellets 102 and a barrel 103 being arranged perpendicularly to the loading entry 101 and connecting the delivery tube 80 so that when the passage for firing 84 sends out strong airflow, the pullets—airsoft pellets—102 is fired. Additionally, the pneumatic firing device 90 and the loading device 100 are disposed inside a housing 200, and the housing 200 further includes a grip 201 arranged corresponding to the solenoid valve 25 and the external air supply tube 14 for pressured air to enter via an air inlet 202 connecting to the external air supply tube 14. The pressured air may come from a gas cylinder or other pneumatic devices. Also, the grip 201 includes a trigger 203 for pulling and the loading device 100 can be engaged a magazine 204, as designed for application to BB guns.

The operations and applications of the pneumatic firing device 90 are described as following with referred drawings.

Figure 1:
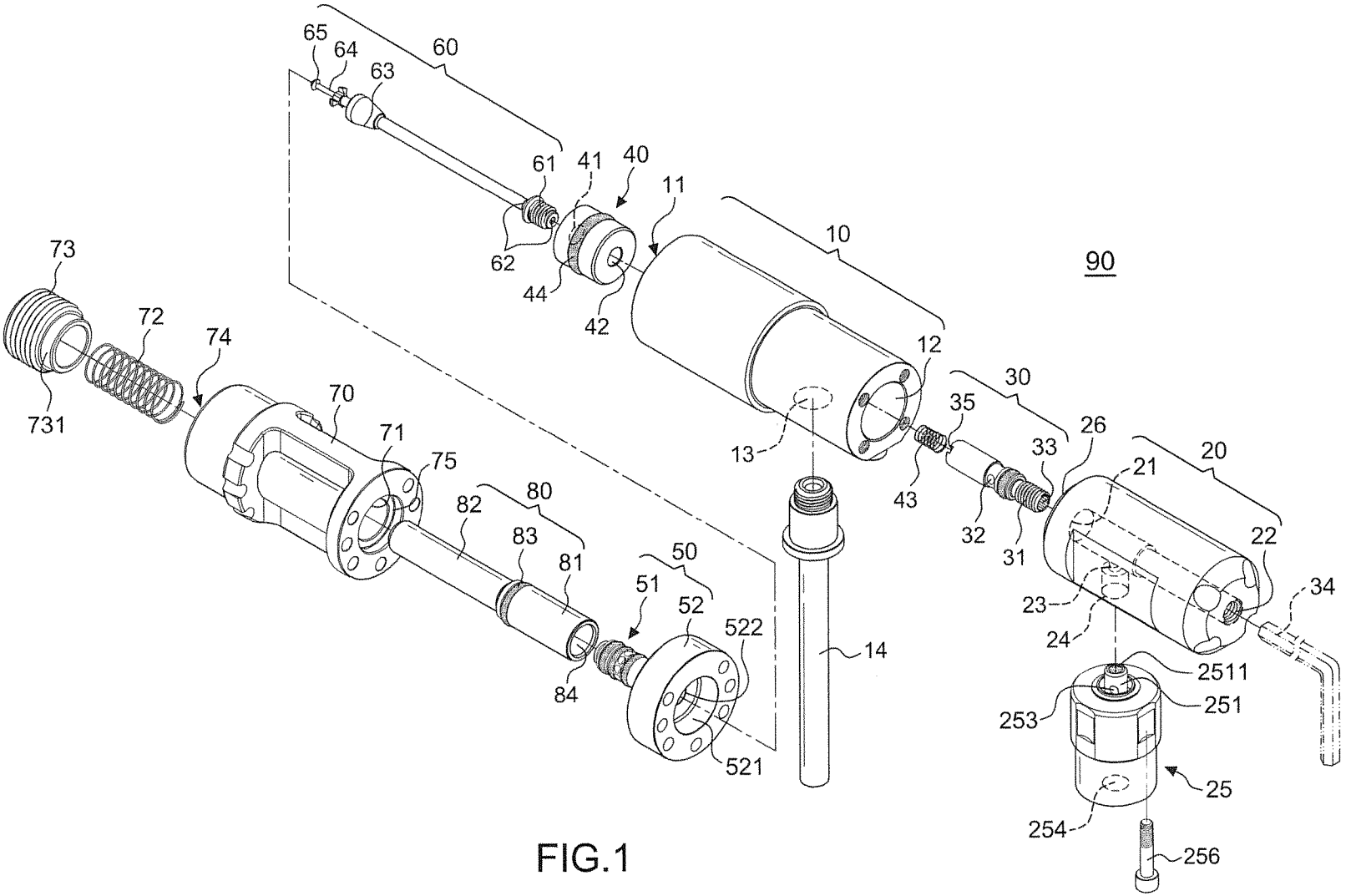
FIG. 1 is an exploded view of the present invention.
Figure 1A:
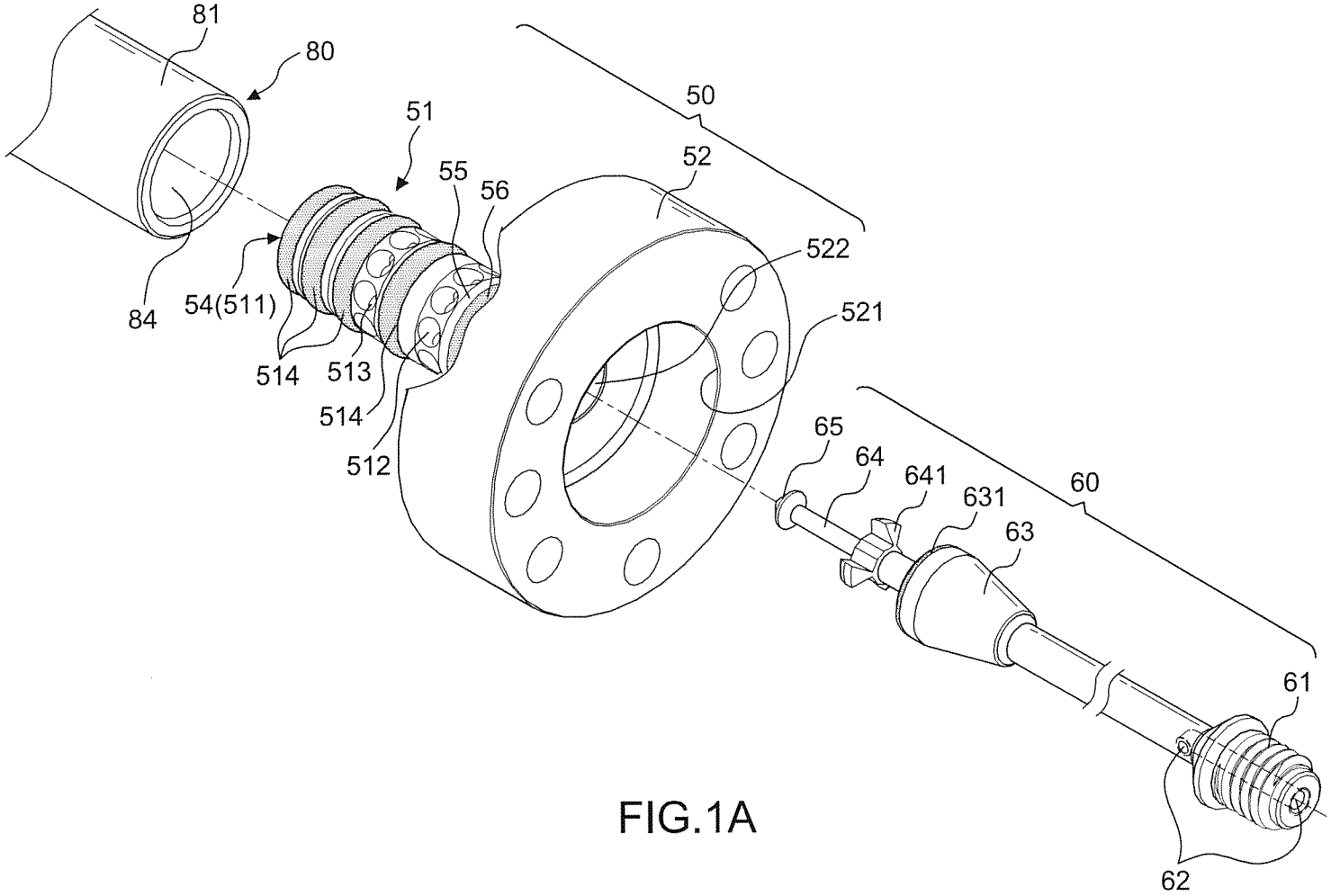
FIG. 1A is an enlarged view of major components of the present invention.
Figure 2:
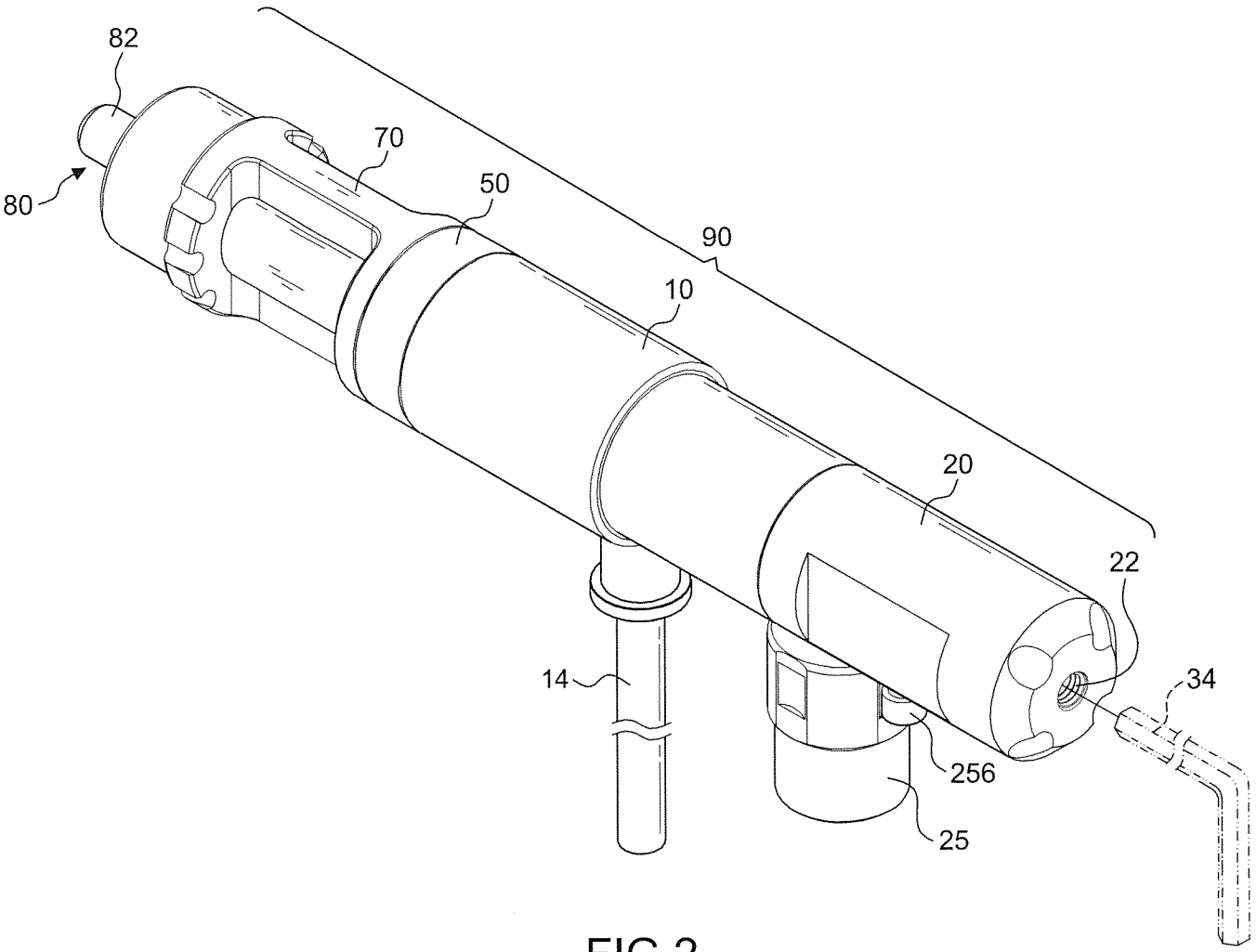
FIG. 2 is a perspective view of the present invention.
Figure 3:
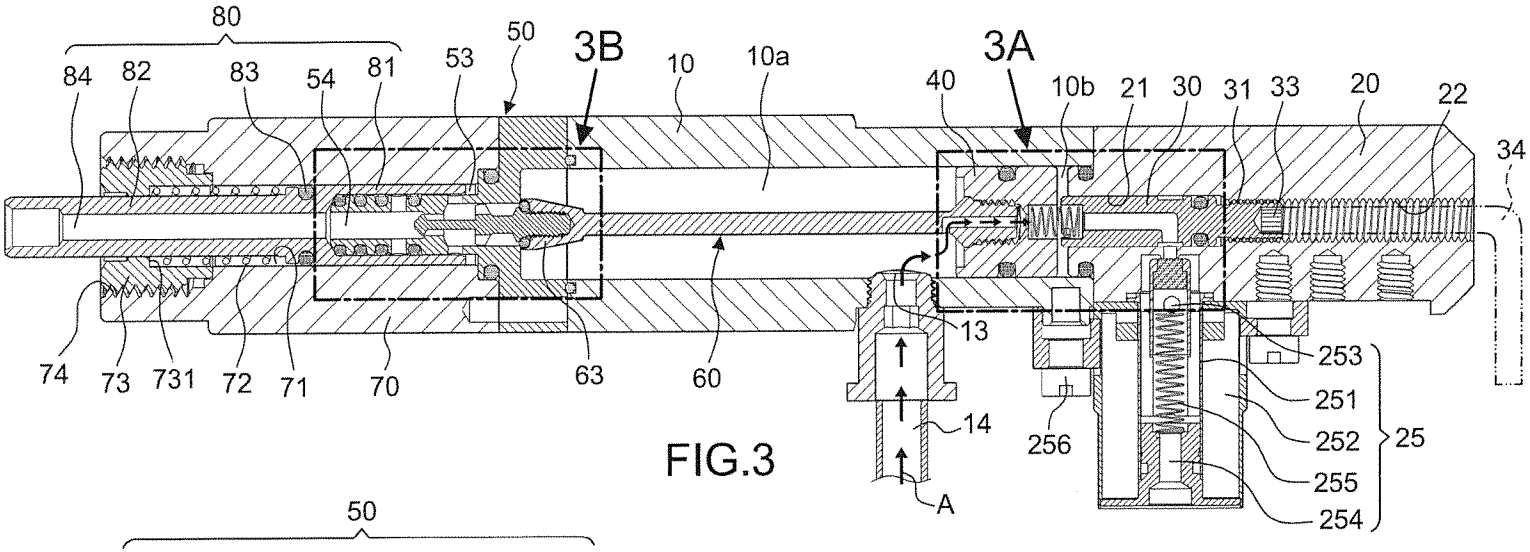
FIG. 3 is a sectional view of the present invention illustrating a movable plunger thereof in the original closing status.
Figure 3A:
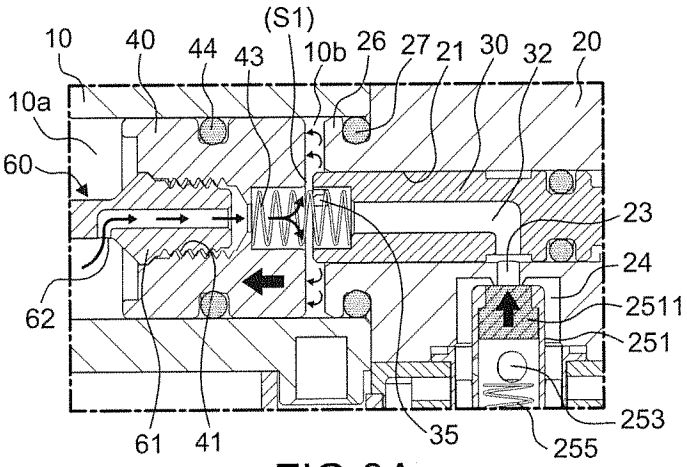
FIG. 3A is an enlarged view of area 3A in FIG. 3.
Figure 3B:
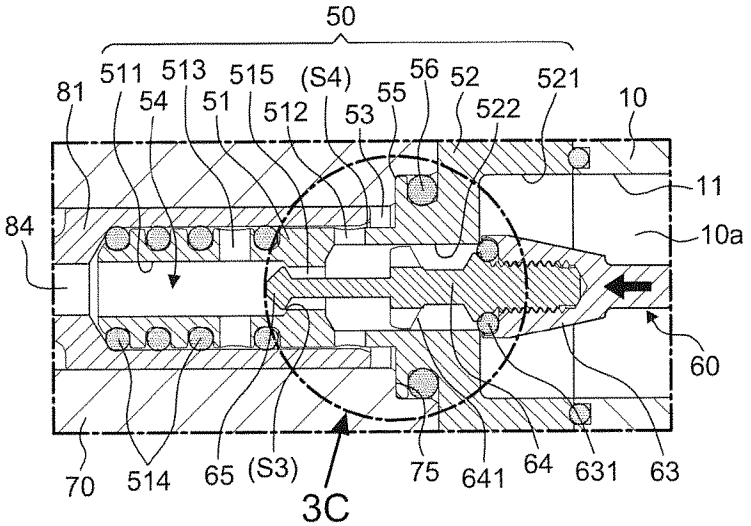
FIG. 3B is an enlarged view of area 3B in FIG. 3.
Figure 3C:
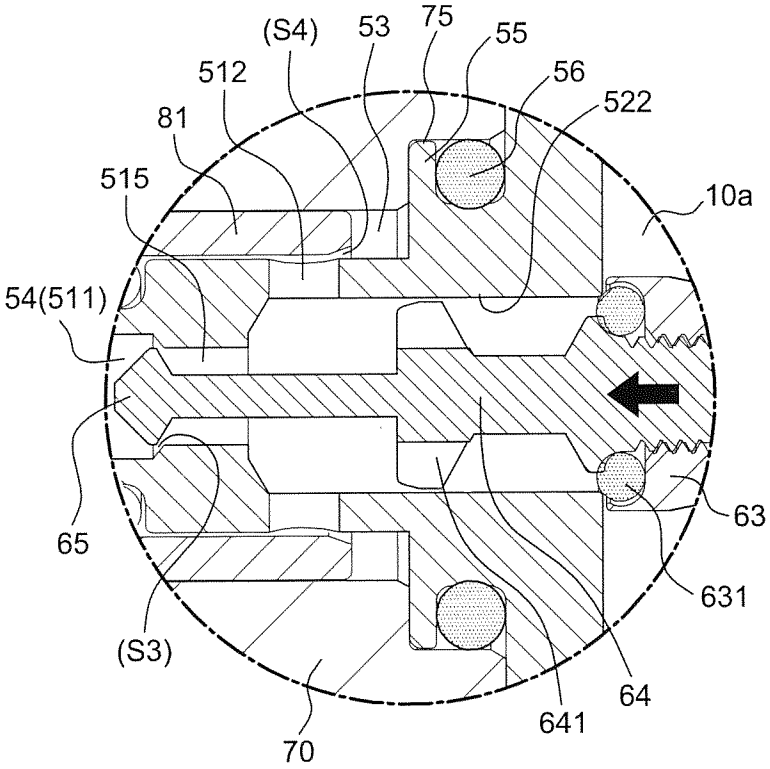
FIG. 3C is an enlarged view of area 3C in FIG. 3B.

Referring to FIGS. 3-3C, the movable plunger 251 of the solenoid valve 25 is originally closing and blocking the pressure release vent 23 of the pressure release room 24. In this embodiment, the second spring 43 provides a pushing force for the piston 40 to move forward, therefore forming a first gap S1 between the piston 40 and the adjusting element 30, so that the pressure air A entering a first chamber 10*a* arranged at a front side of the piston 40 via the first entry hole 13 is able to rapidly enter a second chamber 10*b* arranged at a rear side of the piston 40 via the second entry hole 62 through the first gap S1. Also, the pressured air A can enter the second chamber 10*b* via the through hole 35 at the front of the adjusting element 30. In other words, even if the piston 40 moves backwards and block the first gap S1, the pressure air A will not be blocked for flowing into the second chamber 10*b*. The space of the first gap S1 is decided by the displacement of the adjusting element 30 in the first hole 21 and is controlled thereby during operation. Then, when the pressure release vent 23 is blocked by the movable plunger 251, the pressured air A is blocked as well; the piston 40 then moves forward due to the pressure difference and abuts the valve 63 of the moving rod 60 to the guiding passage 522, blocking the pressured air A in the first chamber 10*a* and producing a pushing force X. The delivery tube 80 thereby returns to original status with the ejection force from the first spring 83.

Figure 4C:
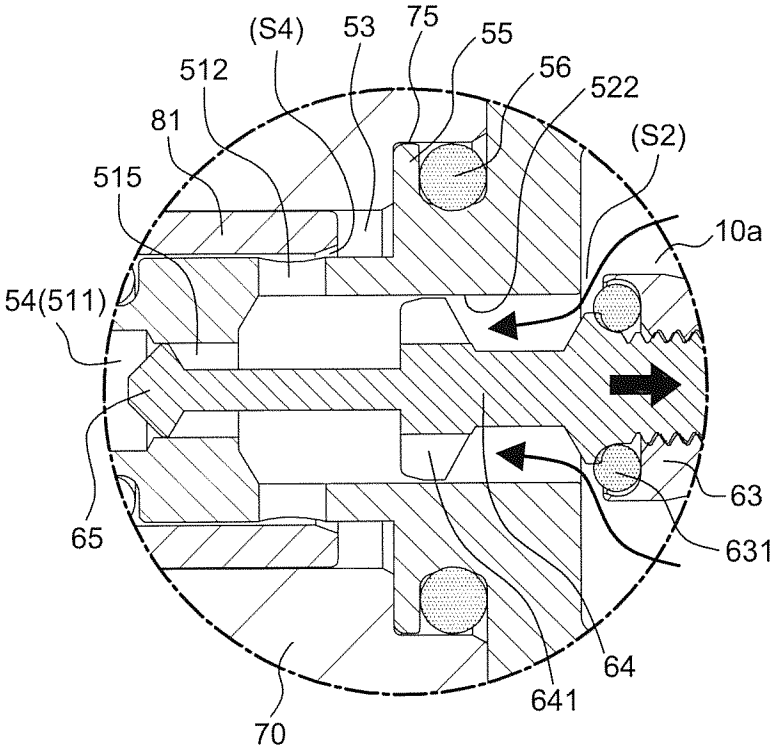
FIG. 4C is an enlarged view of area 4C in FIG. 4B.
Figure 4:
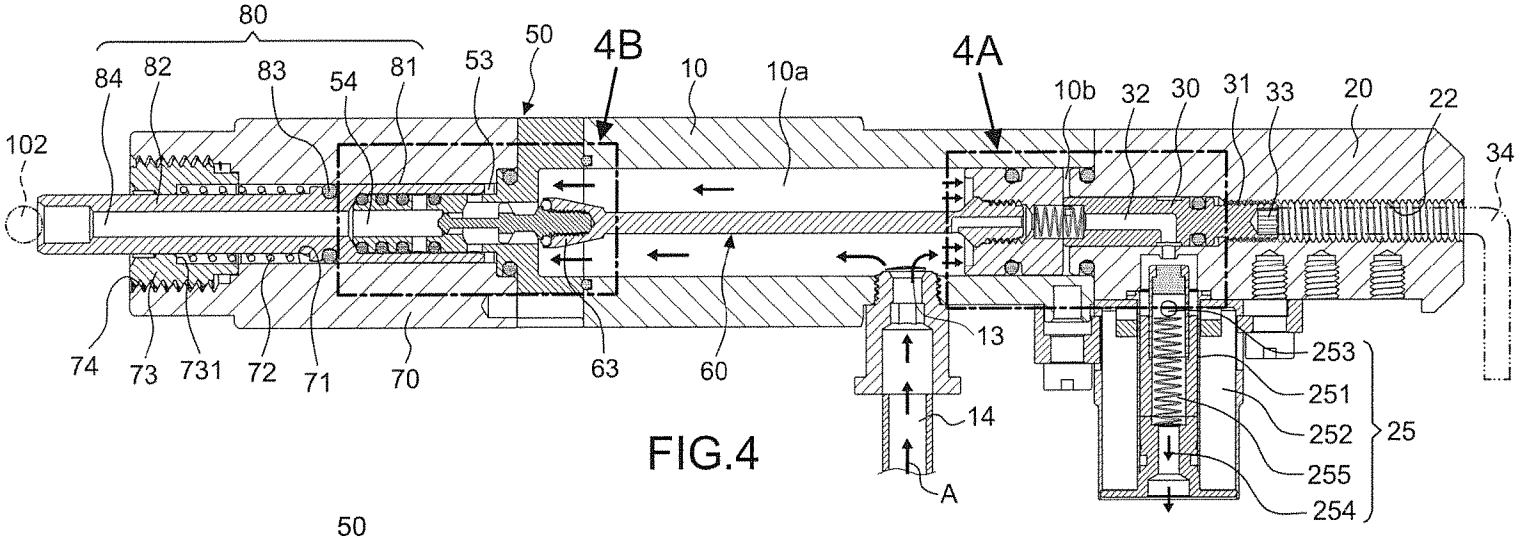
FIG. 4 is a sectional view of the present invention illustrating the movable plunger and a valve thereof in an opening status.
Figure 4A:
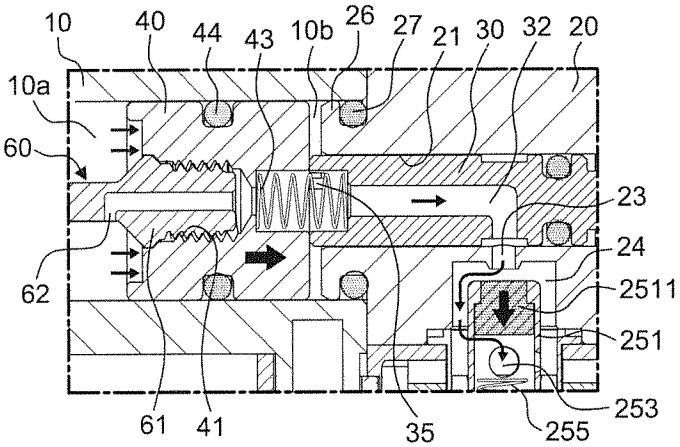
FIG. 4A is an enlarged view of area 4A in FIG. 4.
Figure 4B:
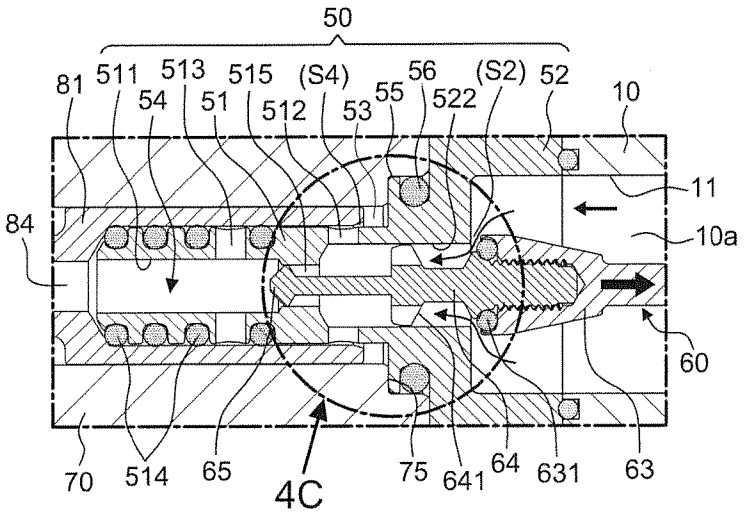
FIG. 4B is an enlarged view of area 4B in FIG. 4.

Referring to FIGS. 4-4C, the movable plunger 251 opens the pressure release vent 23 by the trigger 203, and the pressured air A enters into the pressure release room 24 via the pressure release channel 32, then flow through the first outlet 253 of the movable plunger 251 and be discharged from the second outlet 254. The pressure force in the first chamber 10*a* is therefore stronger than the force of the second spring 43 and the pushing force X, thereby detaching the valve 63 from the guiding passage 522 and forming a second gap S2, so that the pressured air A in the first chamber 10*a* would flow out from the guiding passage 522 into the first passage 53 via the first guiding hole 512 and the fourth gap S4 and go to the second tube 82 of the delivery tube 80.

Figure 5:
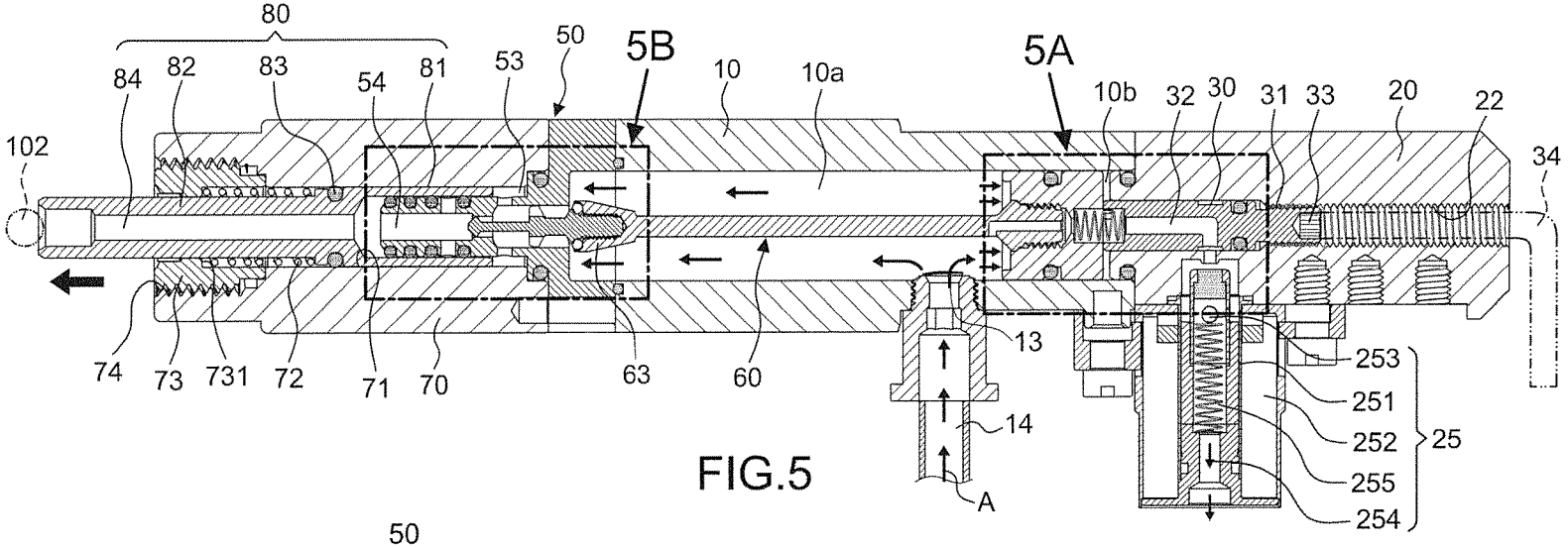
FIG. 5 is a sectional view of the present invention illustrating airflow entering a second hole thereof from a first guiding hole thereof.
Figure 5A:
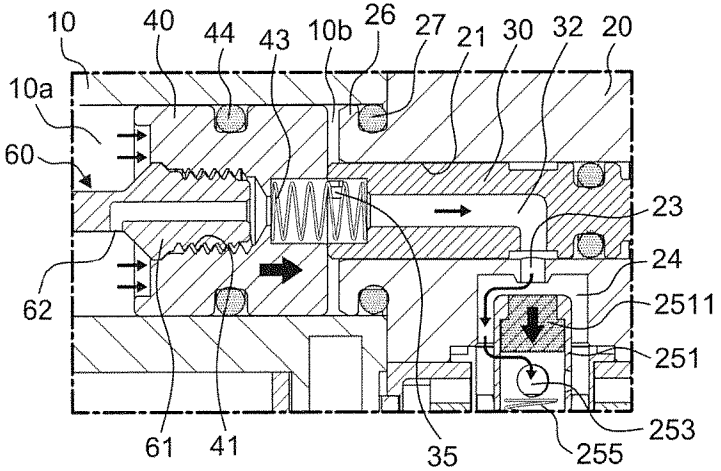
FIG. 5A is an enlarged view of area 5A in FIG. 5.
Figure 5B:
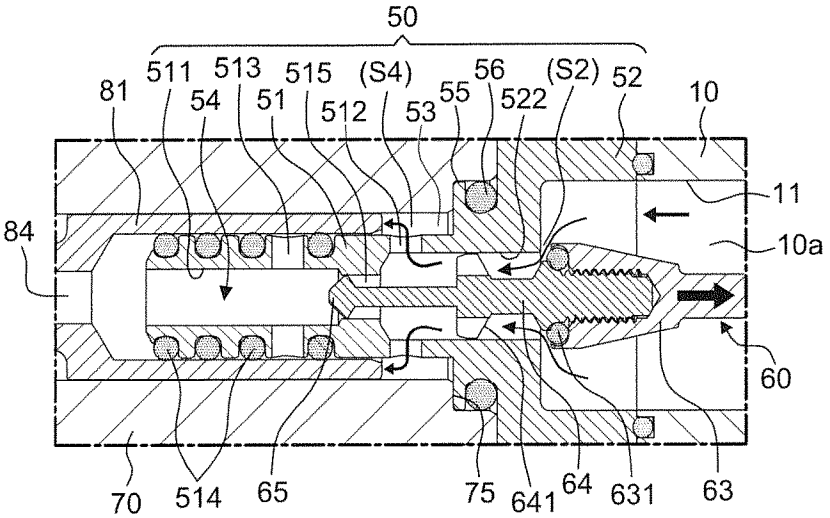
FIG. 5B is an enlarged view of area 5B in FIG. 5.

FIGS. 5-5B illustrated the operation process of the pressured air A moving the delivery tube 80 forward. The first tube 81 of the delivery tube 80 detaches from the first guiding hole 512 but does not detach from the second guiding hole 513 yet; meanwhile the delivery tube 80 sends the airsoft pellet 102 into the barrel 103 from the loading entry 101.

Figure 6:
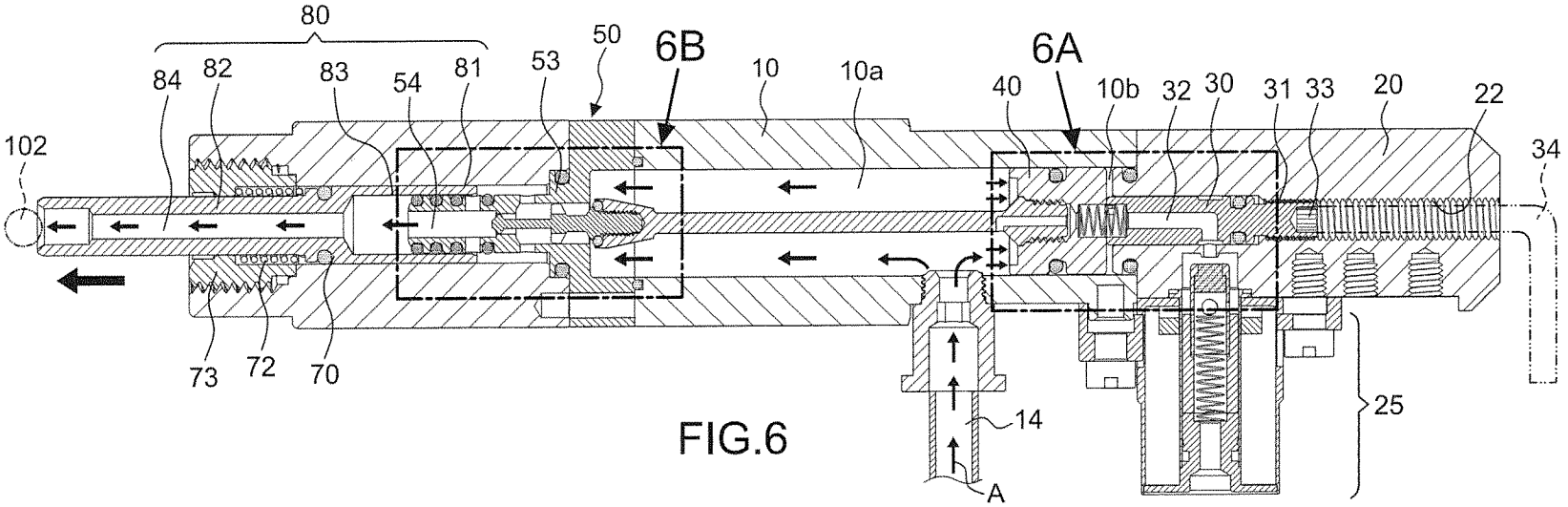
FIG. 6 is a sectional view of the present invention illustrating airflow entering a passage for firing thereof from a second guiding hole thereof.
Figure 6A:
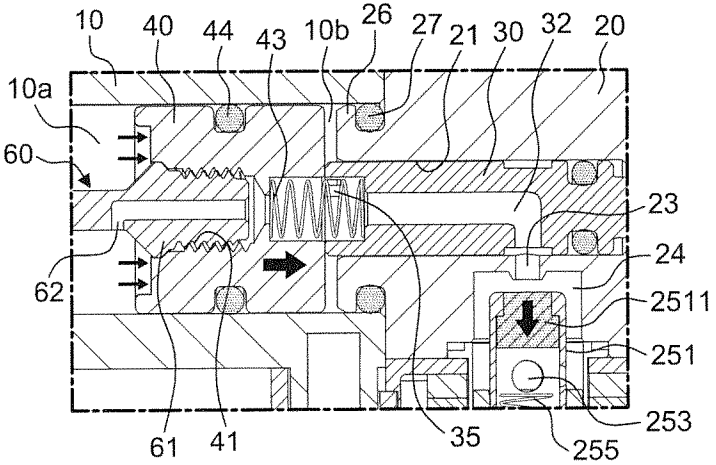
FIG. 6A is an enlarged view of area 6A in FIG. 6.
Figure 6B:
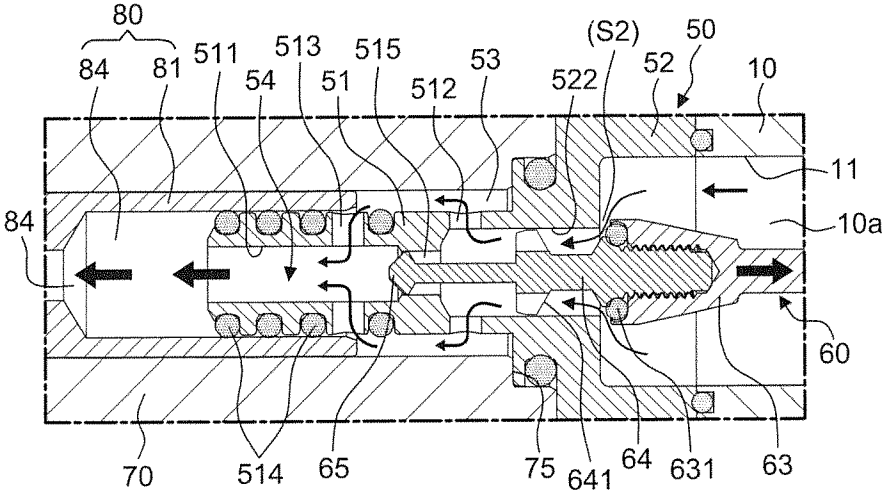
FIG. 6B is an enlarged view of area 6B in FIG. 6.

Further referring to FIGS. 6-6B, when the first tube 81 of the delivery tube 80 leaving the second guiding hole 513, the pressured air A flows into the second passage 54 via the first passage 53 and the second guiding hole 513, then fires the airsoft pellet 102 via the passage for firing 84 with strong airflow.

Figure 7B:
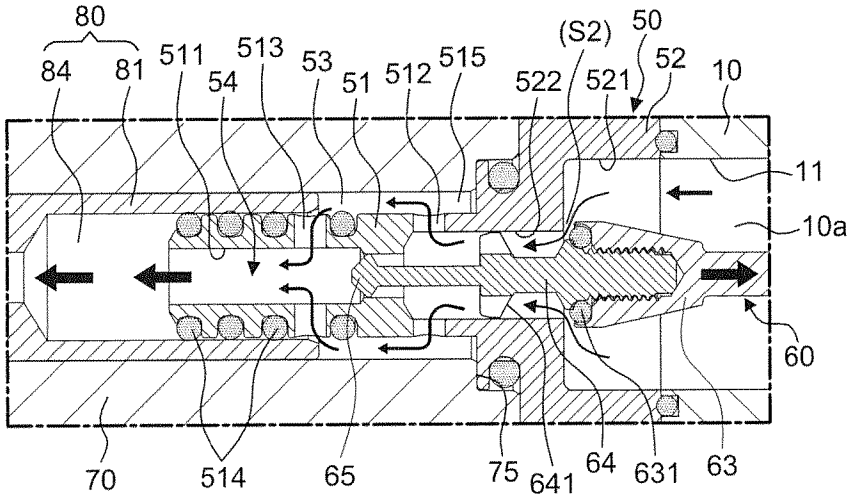
FIG. 7B is an enlarged view of area 7B in FIG. 7.
Figure 8B:
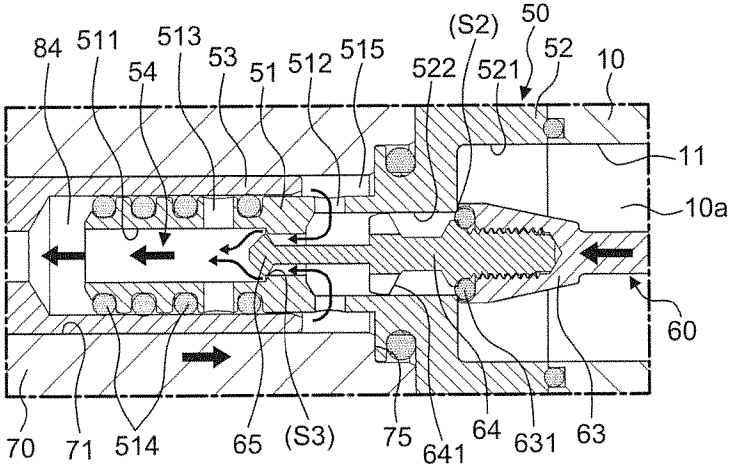
FIG. 8B is an enlarged view of area 8B in FIG. 8.

Then, referring to FIGS. 7-7B, the movable plunger 251 returns to block the pressure release channel 32 again and the air pressure in the second chamber 10*b* has changed, thus moving the piston 40 forward. The first spring 72 sends the delivery tube 80 back to the original position and the piston 40 moves forward again, back to the original closing status as shown in FIGS. 8-8B. The valve 63 abuts to the guiding passage 522 again and blocks the second gap S2 to stop the pressured air A flowing from the guiding passage 522; and the third gap S3 is opened to discharge the rest pressured air A. Then the device returns back to the original status as shown in FIG. 3—the delivery tube 80 is ejected by the first spring 72 and forms the first gap S1.

With aforesaid structures and measures, the present invention has A change of air pressure to operate the pneumatic device 90. It pushed the airsoft pellet 102 in the delivery tube with weak airflows, and then fires with a strong one. Such structure has effects described as following.

1. With the solenoid valve 25 controlling the operation of the pressure release channel 32 to change the pressure difference between the first chamber 10*a* and the second chamber 10*b*, the pressured air A flows into the first passage 53 via the first guiding hole 512 of the airflow guiding element 50, displacing the delivery tube 80 forward and driving a airsoft pellet 102 therein to move forward, and then flows into the second passage 54 via the second guiding hole 513 to fire the airsoft pellet 102 from the passage for firing 84 with strong airflow. The air flows smoothly during the operation, thus increasing the firing speed.

2. With such simple structure, the present invention is easily assembled and therefore less malfunctioned. In addition, the pneumatic firing device 90 is modular for various applications to different devices.

3. The first passage 53 is a minor passage for airflow to gather and enter the second passage 54 which is the major passage for the operation. The airflow is therefore able to strongly fire the airsoft pellet 102 during the operation. Consequently the present invention is able to smoothly operate the firing with low pressure, ensuring more safety and less cost for manufacturing.

4. The displacement of the adjusting element 30 in the first hole 21 of the rear section 20 is able to control the operation of the piston 40, thus enabling the device to adjust the firing speed.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pneumatic firing device comprising:

a hollow cylinder including a first opening arranged at an end thereof, a second opening arranged at the other end thereof, and a first entry hole arranged at a bottom thereof for connecting an external air supply tube;

a rear section having a front end thereof engaging the second opening of the cylinder, a first hole arranged at a front part thereof, a screw hole arranged at a rear part thereof connecting to the first hole, and a pressure release vent arranged at a bottom of and connecting to the first hole; the pressure release vent further linking to a pressure release room at a bottom of the rear section;

a solenoid valve connecting to the pressure release room from under and having a movable plunger as a gate for opening and closing the pressure release room; the movable plunger having a first outlet arranged at a hollow lower part thereof, and a second outlet arranged at a bottom of the solenoid valve for air released from the pressure release room to be discharged therefrom via the first outlet and the second outlet;

an adjusting element engaging in the first hole of the rear section with a tail section arranged as a threaded section for threadedly engaging the screw hole and a front part including a pressure release channel; said pressure release channel having a through hole at a front of said pressure release channel and connecting to the pressure release vent at a rear of said pressure release channel;

a piston disposed in the second opening with an engaging hole arranged at a front thereof and a connecting hollow arranged at a rear thereof for connecting to the engaging hole; a first gap being formed between the piston and the adjusting element when the piston moves forward;

an airflow guiding element engaging the cylinder from a front of the cylinder and having a tube body with a first diameter at a front section of the airflow guiding element, a ring element with a second diameter at a rear of the airflow guiding element, and a guiding passage connecting the tube body and the ring element; the second diameter being greater than the first diameter; the tube body further having at least one first guiding hole arranged thereon at a side near the ring element, forming a first passage connecting the cylinder, and at least one second guiding hole arranged thereon at a side far from the ring element; at least one O-ring being arranged on the tube body between the first guiding hole and the second guiding hole, and an axial hole being arranged within the tube body between the first guiding hole and the second guiding hole, the axial hole connecting to a second passage and the second passage connecting to the second guiding hole;

a moving rod having a tail end engaging the engaging hole of the piston, a second entry hole to link up with the connecting hollow, and a front end extending out the cylinder into the airflow guiding element and including a valve with a diameter of a length between the first and second diameter; said valve further including a stick extending through the axial hole, forming a blocking section to control blocking of the axial hole upon being driven by the moving rod in operation; when the moving rod moves backward and the valve leaves the guiding passage, a second gap is formed in between, and when the moving rod moves forward, a third gap is formed between the blocking section and the axial hole;

a front section engaging the airflow guiding element and having a second hole;

a delivery tube including a first tube and a second tube connecting with each other; a diameter of the first tube being greater than a diameter of the second tube for engaging the tube body, and a first O-ring being arranged on the surface of the first tube corresponding to the second hole for the delivery tube to displace in the second hole; the first tube further coupling to the second passage to form a passage for firing, and when the delivery tube returns to a first position, a fourth gap is formed between the first tube and the first guiding hole;

a first spring mounted around the second tube and positioned at a front of the front section by a positioning element in order to constantly provide an inward force for the delivery tube, so as to confine displacement of the delivery tube;

whereby the solenoid valve holds control of operation of the pressure release channel to change a pressure difference between a first chamber arranged at a front side of the piston and a second chamber arranged at a rear side of the piston, then pressured air flows into the first passage via the first guiding hole of the airflow guiding element, displacing the delivery tube and driving a pellet therein to move forward, and then flows into the second passage via the second guiding hole to fire the pellet from the passage for firing with strong airflow.

2. The pneumatic firing device as claimed in claim 1, further including a small second spring disposed between the adjusting element and the connecting hollow for providing an ejection force for the piston to move forward.

3. The pneumatic firing device as claimed in claim 1, wherein the adjusting element has a non-circular socket arranged at a tail end thereof for a wrench to adjust the position of the adjusting element from the screw hole of the rear section.

4. The pneumatic firing device as claimed in claim 1, wherein a plurality of blades is arranged at a middle section of the stick and the blocking section has inclined surfaces extending to both ends.

5. The pneumatic firing device as claimed in claim 1, wherein the positioning element is a short bolt to be fixed in a front screw hole at the front of the front section, and the positioning element further has a protruding abutting surface arranged on the inner periphery for positioning the first spring.

6. The pneumatic firing device as claimed in claim 1, wherein the front section further has a first concave end engaging a first convex end of the airflow guiding element, and the first convex end has a second O-ring mounted thereon in order to seal the engaging ends.

7. The pneumatic firing device as claimed in claim 1, wherein the rear section further has a second concave end with a third O-ring mounted thereon to seal the engaging rear section and second tube of the cylinder.

8. The pneumatic firing device as claimed in claim 1, wherein the delivery tube is further engaging a loading device including a loading entry for the supply of pellets and a barrel being arranged perpendicularly to the loading entry and connecting the delivery tube.

9. The pneumatic firing device as claimed in claim 8, wherein the device and the loading device are disposed inside a housing, and the housing further includes a grip arranged corresponding to the solenoid valve and the external air supply tube; the grip further has an air inlet connecting the external air supply tube.

* * * * *